US008925744B1

(12) United States Patent
Jang et al.

(10) Patent No.: US 8,925,744 B1
(45) Date of Patent: Jan. 6, 2015

(54) TWO TIERED SHELF DISPLAY

(71) Applicant: POP Displays USA LLC, Yonkers, NY (US)

(72) Inventors: Jin-Ha Jang, Elmhurst, NY (US); Cliff Lu, Little Neck, NY (US); Michael Christopher Allen, Mamaroneck, NY (US)

(73) Assignee: POP Displays USA LLC, Yonkers, NY (US)

( * ) Notice: Subject to any disclaimer, the term of this patent is extended or adjusted under 35 U.S.C. 154(b) by 0 days.

(21) Appl. No.: 13/931,964

(22) Filed: Jun. 30, 2013

Related U.S. Application Data

(60) Provisional application No. 61/667,256, filed on Jul. 2, 2012.

(51) Int. Cl.
*A47F 1/04* (2006.01)
*A47F 3/14* (2006.01)

(52) U.S. Cl.
CPC ..... *A47F 1/04* (2013.01)
USPC ..... 211/59.2; 211/126.12

(58) Field of Classification Search
USPC ..... 211/59.2, 59.3, 193, 87.01, 134, 126.2, 211/126.12
See application file for complete search history.

(56) References Cited

U.S. PATENT DOCUMENTS 2,218,444 A * 10/1940 Vineyard ..... 211/59.2
2,915,162 A * 12/1959 Umstead ..... 193/27
3,286,846 A 11/1966 Brandes
3,318,455 A * 5/1967 Takahashi ..... 211/59.2
3,393,808 A 7/1968 Chirchill
3,795,345 A 3/1974 Baxendale
4,310,097 A * 1/1982 Merl ..... 211/59.2
4,356,923 A * 11/1982 Young et al. ..... 211/59.2
4,386,703 A * 6/1983 Thompson et al. ..... 206/557
D290,790 S * 7/1987 Nathan et al. ..... D6/408
4,998,628 A * 3/1991 Ross ..... 211/59.2
5,141,105 A * 8/1992 Maye ..... 211/135
5,356,033 A * 10/1994 Delaney ..... 221/194
5,706,958 A * 1/1998 Spamer ..... 211/59.2
6,168,032 B1 * 1/2001 Merl ..... 211/59.2
6,360,901 B1 * 3/2002 Parham ..... 211/59.2
6,502,408 B1 * 1/2003 Corcoran ..... 62/63
6,637,604 B1 * 10/2003 Jay ..... 211/59.2
7,665,618 B2 * 2/2010 Jay et al. ..... 211/59.2
7,918,365 B2 * 4/2011 White et al. ..... 221/191
7,922,014 B2 * 4/2011 Hassell ..... 211/71.01
7,992,747 B2 * 8/2011 Bauer ..... 221/197
7,997,427 B2 * 8/2011 Lowenbraun et al. ..... 211/59.2
8,047,400 B1 11/2011 Luberto et al.
8,657,126 B1 * 2/2014 Loftin et al. ..... 211/59.2
(Continued)

*Primary Examiner* — Joshua J Michener
*Assistant Examiner* — Devin Barnett
(74) *Attorney, Agent, or Firm* — Collard & Roe, P.C.; Christopher Garvey

(57) ABSTRACT

One embodiment of the invention relates to a two-tiered shelf display having a plurality of trays one stacked on top of the other. The trays can have both channels where each channel from a top tray feeds into the corresponding channel on a bottom tray. At least one embodiment includes the two tray system with the first try serving as a base tray and a second tray serving as a top tray which can be coupled to or configured to rest upon the base tray. These trays can be configured to rest upon a rack. The rack can be part of the shelf system as well.

1 Claim, 30 Drawing Sheets

(56) References Cited

U.S. PATENT DOCUMENTS

| | | | | |
|---|---|---|---|---|
| 8,668,114 | B2 * | 3/2014 | Gelardi et al. | 221/285 |
| 2006/0278591 | A1 * | 12/2006 | Tippets et al. | 211/59.2 |
| 2008/0067188 | A1 * | 3/2008 | White et al. | 221/123 |
| 2009/0308885 | A1 * | 12/2009 | Sainato et al. | 221/194 |
| 2010/0096401 | A1 * | 4/2010 | Sainato et al. | 221/8 |
| 2011/0147323 | A1 * | 6/2011 | Sainato et al. | 211/59.2 |
| 2012/0217213 | A1 * | 8/2012 | Thomas | 211/59.2 |
| 2012/0285976 | A1 * | 11/2012 | Bogdziewicz et al. | 221/1 |
| 2013/0233813 | A1 * | 9/2013 | Zacherle et al. | 211/59.2 |
| 2013/0248468 | A1 * | 9/2013 | Burton et al. | 211/59.2 |
| 2013/0264351 | A1 * | 10/2013 | Bogdziewicz et al. | 221/1 |
| 2013/0277321 | A1 * | 10/2013 | Zacherle et al. | 211/59.2 |
| 2014/0047745 | A1 * | 2/2014 | Wildrick et al. | 40/661.06 |

* cited by examiner

FIG. 2A
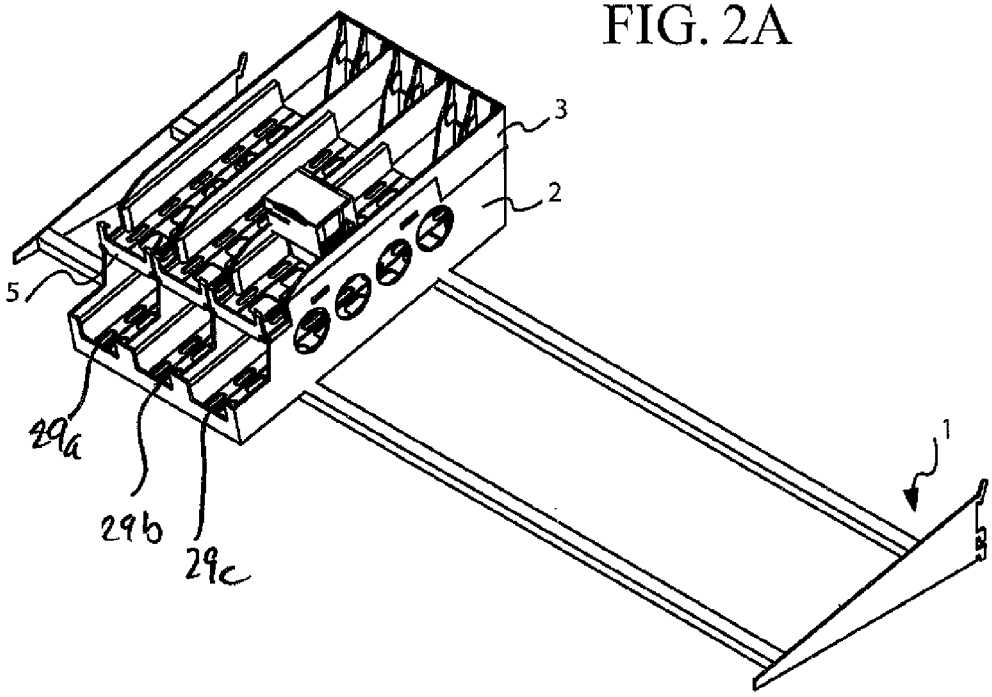
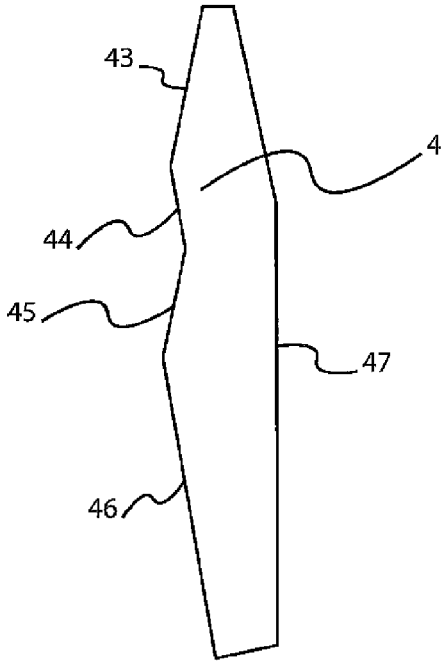
FIG. 2B

FIG. 3A
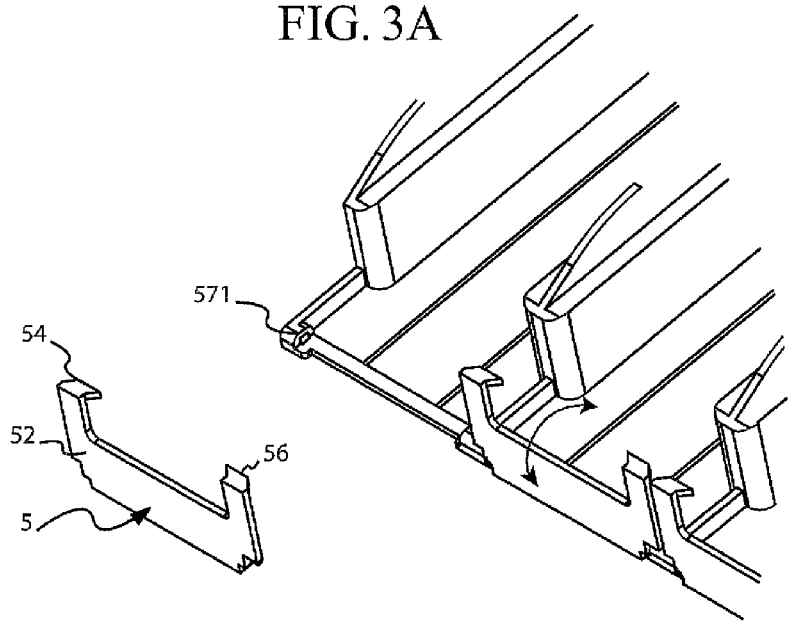
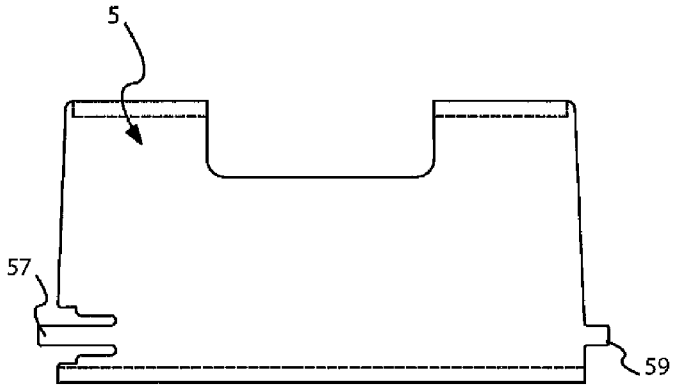
FIG. 3B
FIG. 3C
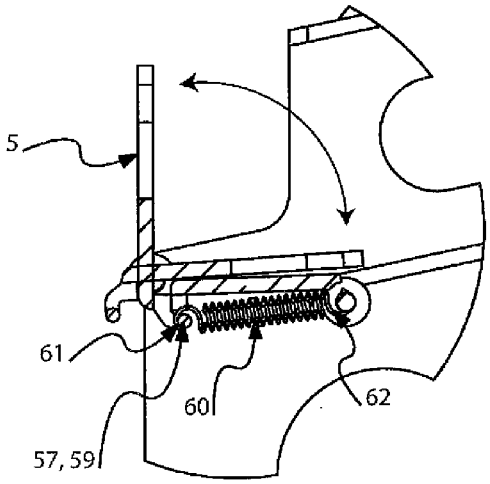

FIG. 31
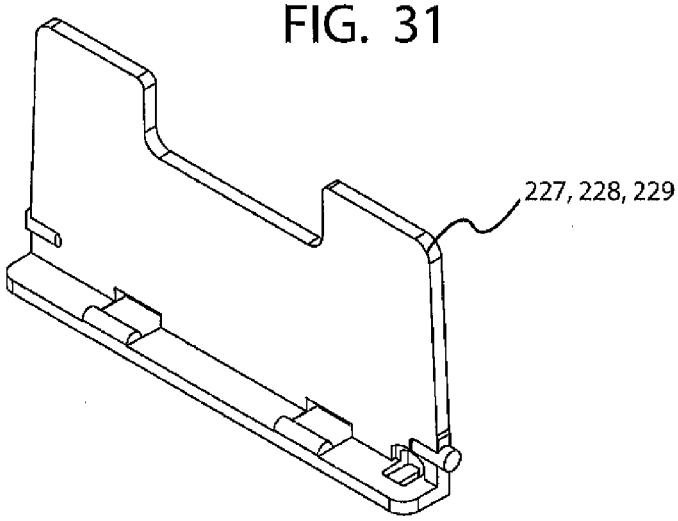
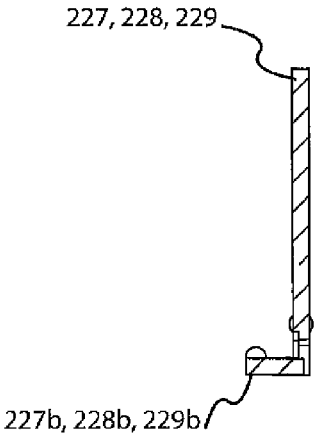
FIG. 30
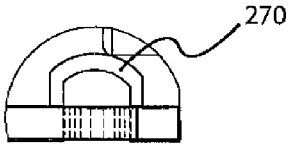
FIG. 32

FIG. 33
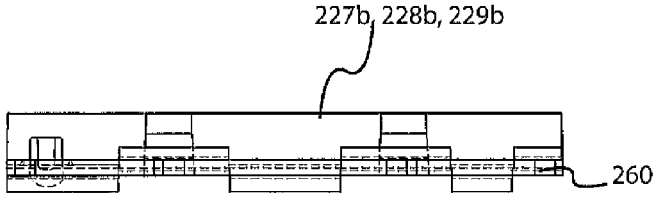
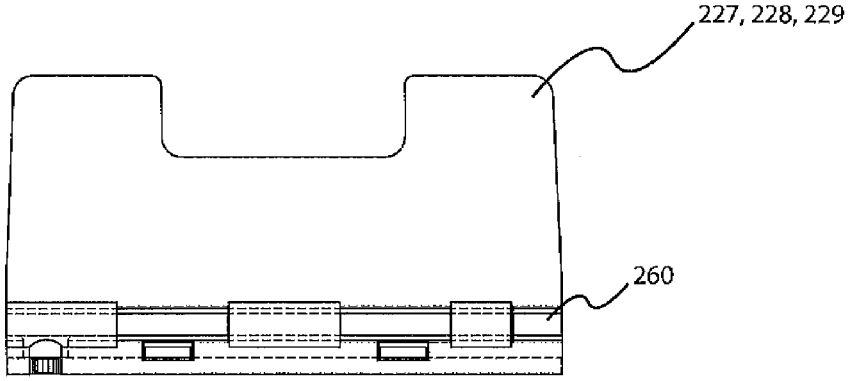
FIG. 34

FIG. 35
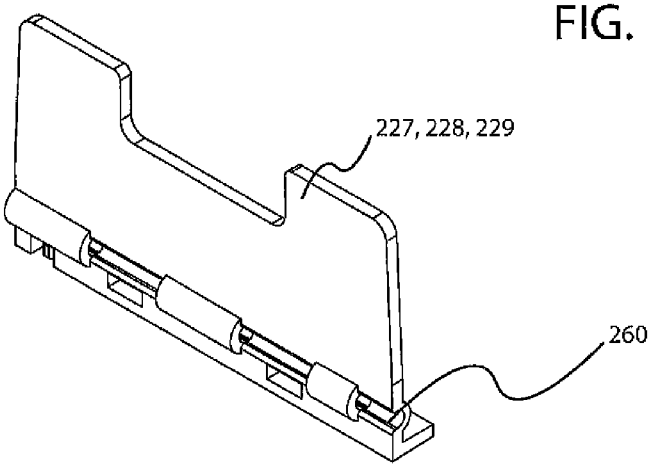
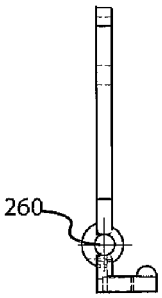
FIG. 36
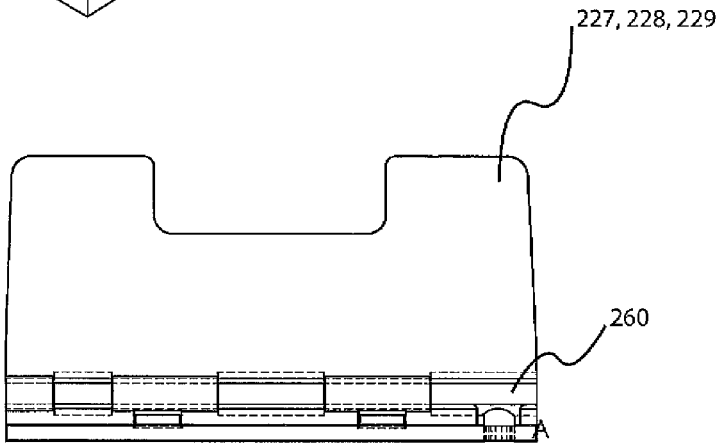
FIG. 37

FIG. 39
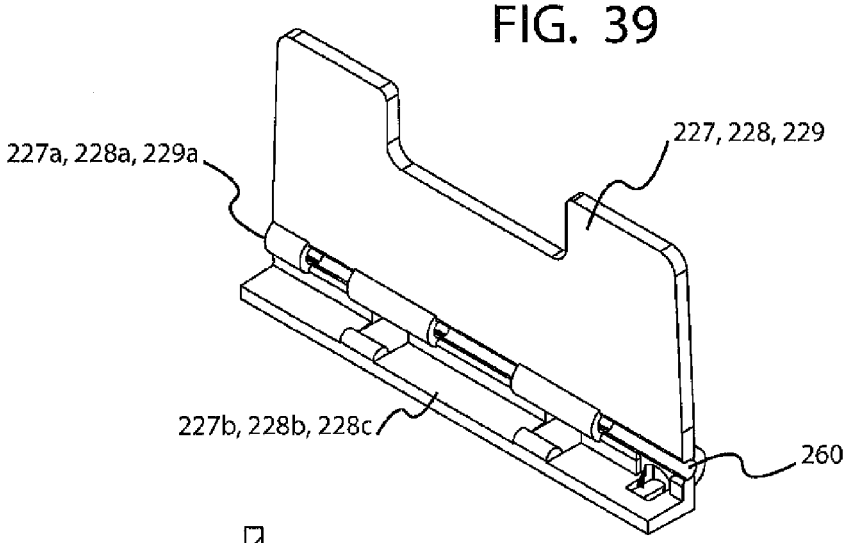
FIG. 38
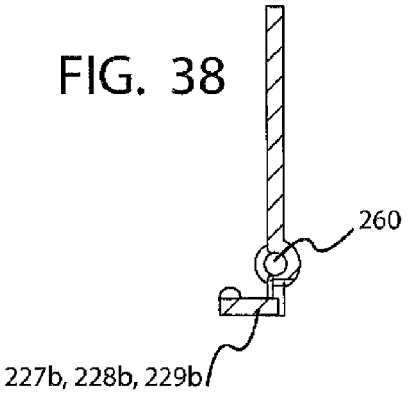
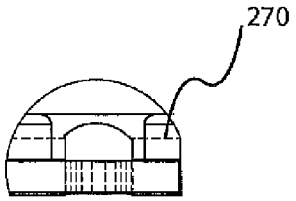
FIG. 40

TWO TIERED SHELF DISPLAY

CROSS REFERENCE TO RELATED APPLICATIONS

This application is a non-provisional application that hereby claims priority under 35 U.S.C. 119e from provisional application Ser. No. 61/667,256 filed on Jul. 2, 2012 the disclosure of which is hereby incorporated herein by reference in its entirety.

BACKGROUND OF THE INVENTION

The invention relates to a two-tier shelf display which is configured to house two different trays stacked one on top of the other. More particularly, the invention relates to a two-tier feeding system which allows the feeding of products into the display from a top tray to a lower tray, or from a top shelf to a bottom shelf.

SUMMARY OF THE INVENTION

One embodiment of the invention relates to a two-tiered shelf display having a plurality of trays one stacked on top of the other. The trays can have both channels where each channel from a top tray feeds into the corresponding channel on a bottom tray. At least one embodiment includes the two tray system, with the first tray serving as a base tray, and a second tray, serving as a top tray which can be coupled to or configured to rest upon the base tray. These trays or shelf levels can be configured to allow material to drop from one level to a second level through a gap or opening in the tray. These trays can be configured to rest upon a rack. The rack can be part of the shelf system as well.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 2A is an assembled version of the design shown in FIG. 1;

FIG. 2B is a view of the back piece or snap;

FIG. 3A is a sectional view of the front end of one tray;

FIG. 3B is a front view of a door to a tray;

FIG. 3C is a side view of the door;

FIG. 30 is a side cross-sectional view of the door shown in FIG. 25;

FIG. 31 is a perspective view of the door shown in FIG. 25;

FIG. 32 is a side view of the spring used for the door;

FIG. 33 is an end view of the door;

FIG. 34 is a back view of the door;

FIG. 35 is a perspective view of the door;

FIG. 36 is a side view of the door;

FIG. 37 is an end view of the door;

FIG. 38 is a side cross-sectional view of the door;

FIG. 39 is a perspective view of the door; and

FIG. 40 is a close up view of a section of the spring.

DETAILED DESCRIPTION OF PREFERRED EMBODIMENTS

Figure 1:
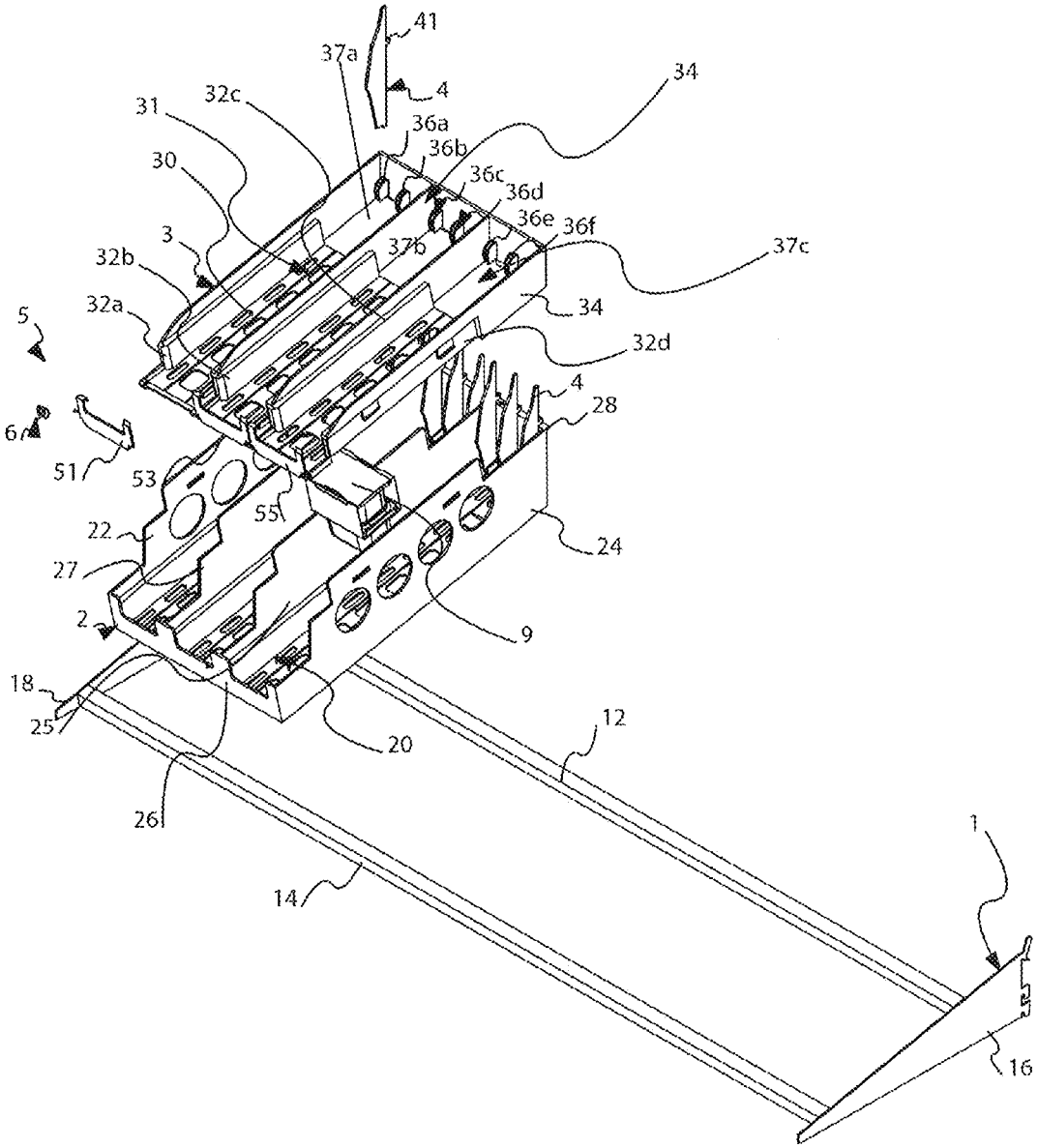
FIG. 1 is an exploded perspective view of a first embodiment.

Turning in detail to the drawings, FIG. 1 shows an exploded perspective view of the shelf system which includes a base frame 1 which includes support beams 12 and 14 as well as brackets 16 and 18. Base frame 1 is configured to support trays 2 and 3 which are configured to sit on base frame 1. Tray 2 is a bottom tray and comprises walls 22, 24, 26 and 28 as well as dividers 25 and 27. Walls 22, 24, 26, and 28 form the outer boundaries for the tray while dividers 25 and 27 form inner dividing partitions forming multiple channels 29*a*, 29*b*, and 29*c* (See FIG. 2A). These channels are configured to allow product 9 to slide or move therein. Tray 2 is configured to be positioned at an angle so that product 9 is gravity fed towards a front display section.

Figure 28:
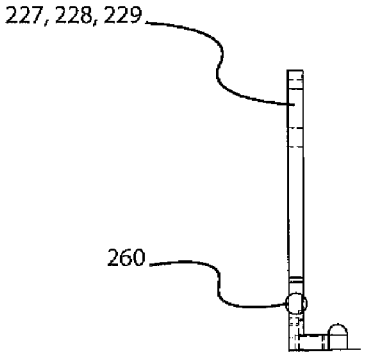
FIG. 28 is an end view of the door shown in FIG. 25.

Tray 3 includes a base section 30 including slots 32*a*, 32*b*, and 32*c*, wherein these slots are configured to receive a frame section 34. Frame section 34 includes: a plurality of prongs 34*a*, 34*b*, 34*c*, and 34*d* which are configured to fit into slots 32*a*, 32*b*, 32*c*, and 32*d* respectively (See FIG. 5) and rest surfaces 33*a*-33*b*, which rest surfaces are inherently serviceable to rest a box (not shown) of product packages 9 (FIG. 1), thereby depressing door 5 (FIG. 3A) and allowing product 9 to be pushed uphill into channels 31*a*-31*b*, from whence the product 9 may fall into tray 2 (FIG. 1) where product 9 will slide forward to the front, for display and dispensing. Thus gravity will always tend to move products in both trays to the front, for display and dispensing. Frame 34 includes a plurality of slots 36*a*, 36*b*, 36*c*, 36*d*, 36*e*, 36*f* which are configured to receive corresponding back wall spacers or snaps 4. These slots and rims form guide rims for products to slide on or to be guided in the slots. Back wall snaps 4 are configured to mate with or couple to a back wall 28 of lower tray 2 in these slots 36*a*-36*f*. Top tray 3 is configured to rest upon and fit into bottom tray 2 and rest thereon (See FIGS. 2A and 28). In particular, in at least one embodiment, back wall snaps include a protrusion 41 which are configured to snap into slots 36*a*-36*f*, to lock these snaps therein. These snaps can also contain a particular geometry as shown in FIG. 28 which includes a plurality of angled surfaces 43, 44, 45, and 46 as well as a back surface 47. These angled surfaces on the snaps are configured to provide guidance for product as it falls from a top shelf to a bottom shelf. For example, angled sections 44 and 45 extends inward into the channel to keep the top of the product from falling too far back. In addition, section 46 is angled in, so as to provide an additional opening so as to allow the product sufficient room to drop from the top level to the bottom level.

Base section 20 of bottom tray 2 includes a floor for which the product slides or is movable thereon. In addition, base section 30 of top tray 3 includes a floor for which product such as product 9 slides thereon as well. Base section 30 is configured to have less area than base section 20 such that at least one opening 37*a*, 37*b*, 37*c*, and 37*d* is formed in this base section. The top tray 3 is formed so that it creates a plurality of channels such as channels 31*a*, 31*b*, 31*c* etc. shown in FIG. 5. Product 9, which can be in the form of baby food packaging, is configured to slide down these channels. In addition, slots 32*a*, 32*b*, 32*c*, and 32*d* form lateral shelf supports 38*a*, 38*b*, 38*c*, and 38*d* which support the product as it slides down the channels (see FIG. 5).

At a front end of this rack is a hinged door 5. Hinged door 5 is shown by way of example as hinged doors 51, 53, and 55. These hinged doors are configured to open and closed based upon springs 6 forming a biased hinge on the hinged door. Springs 6, are coil or torsion springs which bias the door closed. These hinged doors are configured to be rotatably coupled to top tray 3 See FIGS. 3A, 3B, and 3C. For example, as shown in FIG. 3A there is a door 5 which has a base body 52 and a first lip or prong 54 extending out substantially perpendicular to the extension of the body section 52 and extending into the channel extension when the door is installed. A second lip or prong 56 extends substantially parallel to the extension of the body of the door, and substantially perpendicular to the extension of the channel when the door is installed. FIG. 3B shows prongs 57 and 59 which are disposed on a lower section of the door. Prongs 57 and 59 are configured to selectively couple to either a joint 571 (See FIG. 3A) or to a spring 6 as shown in FIG. 3C. For example. FIG. 3C shows spring 6 which includes a body 60 and two ends 61 and 62. A first end is configured to curl around a prong such as prong 57 or 59, while a second end 62 is configured to couple to the body of tray 3 around a prong on tray 3. This door is therefore configured to bend into the channel as shown by the arrows but in at least one embodiment is only configured to rotate approximately 90 degrees. In at least one embodiment, the door can be configured to stop its rotation at a point approximately perpendicular to the extension of its corresponding channel to stop the flow of products down this channel. Therefore, this door is only configured to bend down into the channel and then snap back up.

Figure 4A:
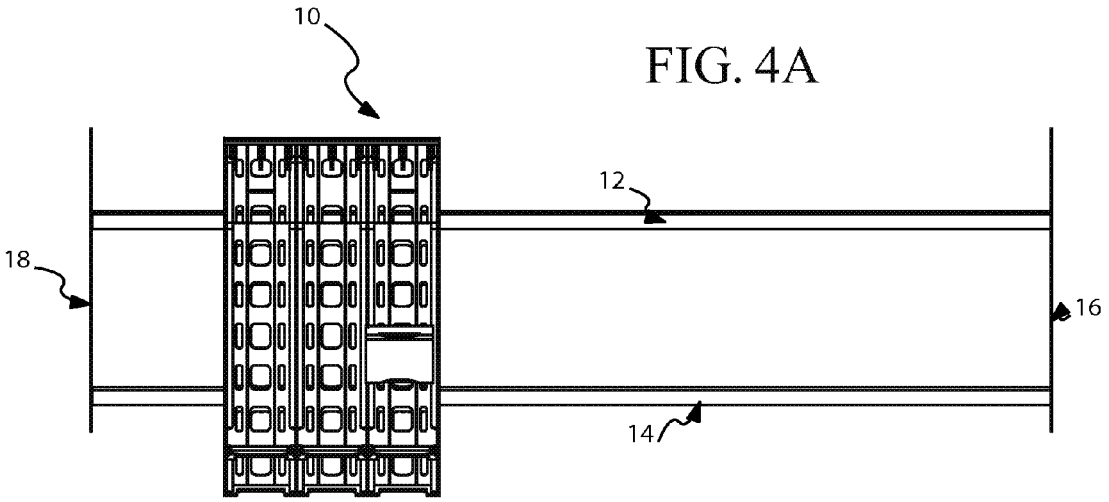
FIG. 4A is a top view of the device of FIG. 1.
Figure 4B:
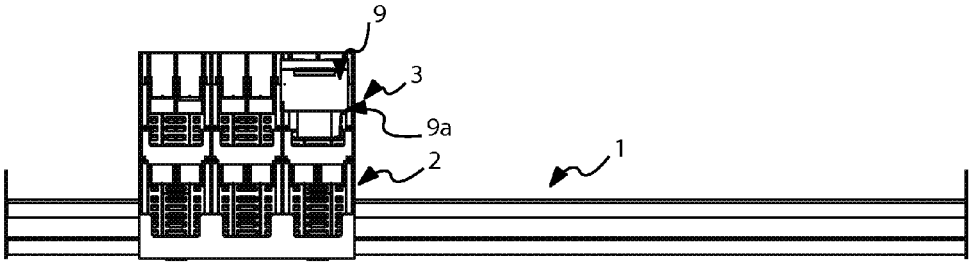
FIG. 4B is s front view of the device of FIG. 1.
Figure 4C:
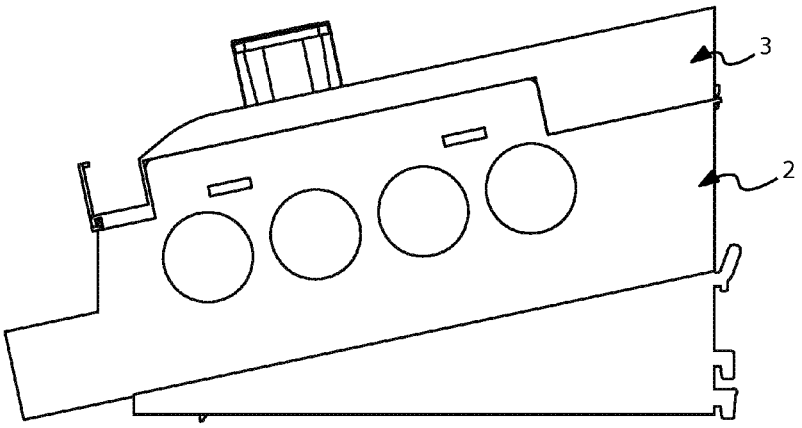
FIG. 4C is a side view of the device of FIG. 1.

FIGS. 4A-4C show a top view a front view and a side view respectively of the two layered tray showing trays 2 and 3 stacked upon base frame or rack 1.

Figure 5:
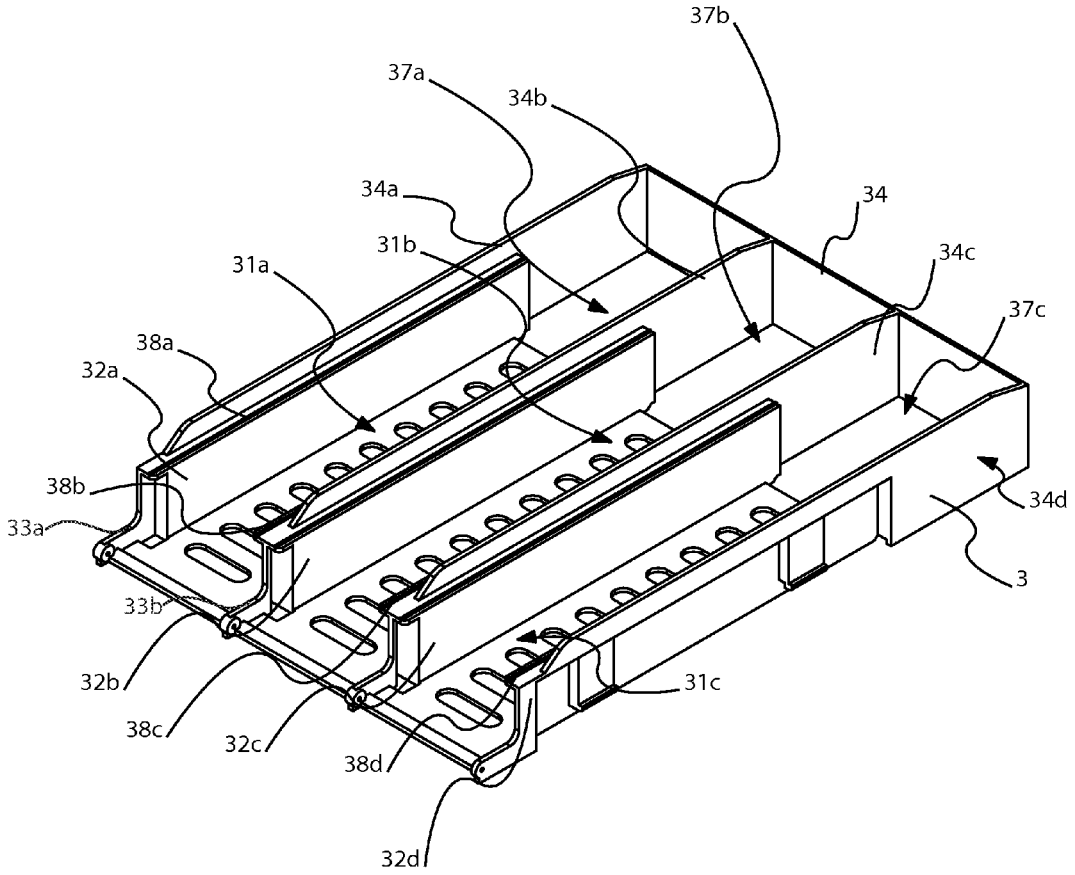
FIG. 5 is a front perspective view of the tray of FIG. 1.

FIG. 5 shows a top perspective view of top tray 3 which includes channels 31*a*, 31*b*, and 31*c* having respective floors. Slots 32*a*, 32*b*, and 32*c* and 32*d* are formed in this top tray 3. In addition, prongs 34*a*, 34*b*, 34*c*, and 34*d* are formed in frame section 34, wherein these prongs are configured to fit into respective slots 32*a*, 32*b*, 32*c*, and 32*d*. These slots form respective shelves 38*a*, 38*b*, 38*c*, and 38*d*. Shelves 38*b* and 38*c* extend on both sides of the respective prongs 34*b* and 34*c*. When product such as product 9 slides down these channels, it can have its side parts 9*a* (See FIG. 4B) rest on shelves 38*a*, 38*b*, 38*c*, and 38*d* thereby supporting this product over the shelf so that it slides easily.

Figure 6:
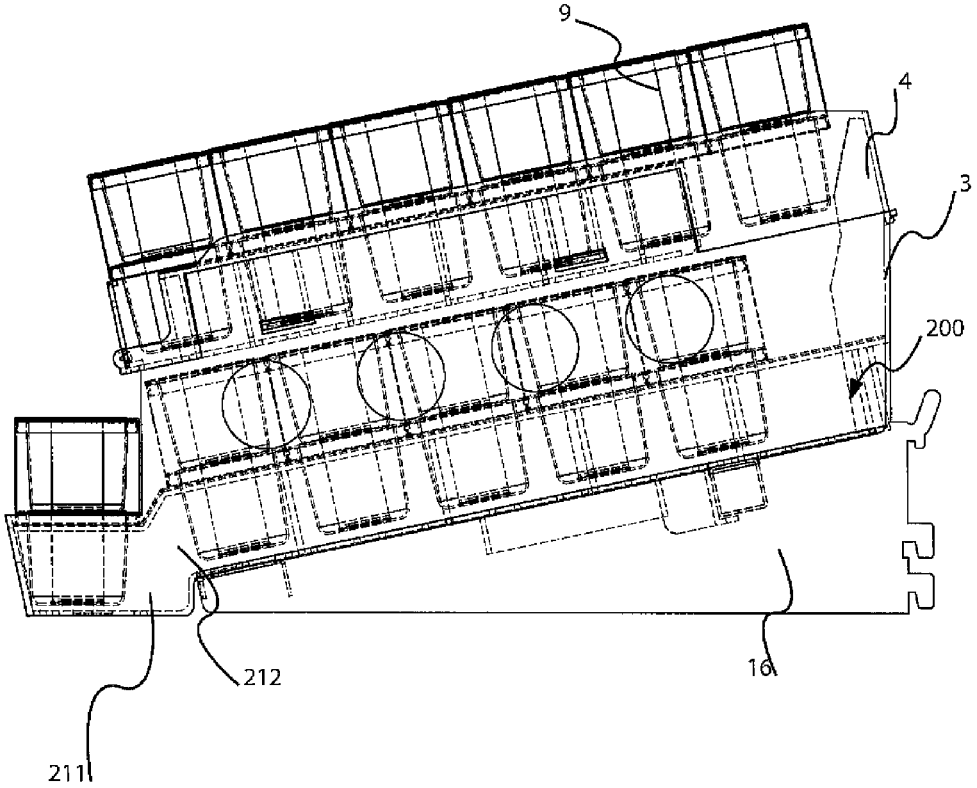
FIG. 6 is a side view of a new embodiment.

FIG. 6 shows a second embodiment which shows a bottom tray 200 which is installed on an angle on side bracket 16. Bottom tray 200 includes a front drop down extension 211 which is configured to bend down at a bend 212 to form a dispensing opening which is further below the upper tray 3. In addition, in this view, snaps 4 are shown installed and extending from bottom tray 200 top top tray 3.

Figure 7:
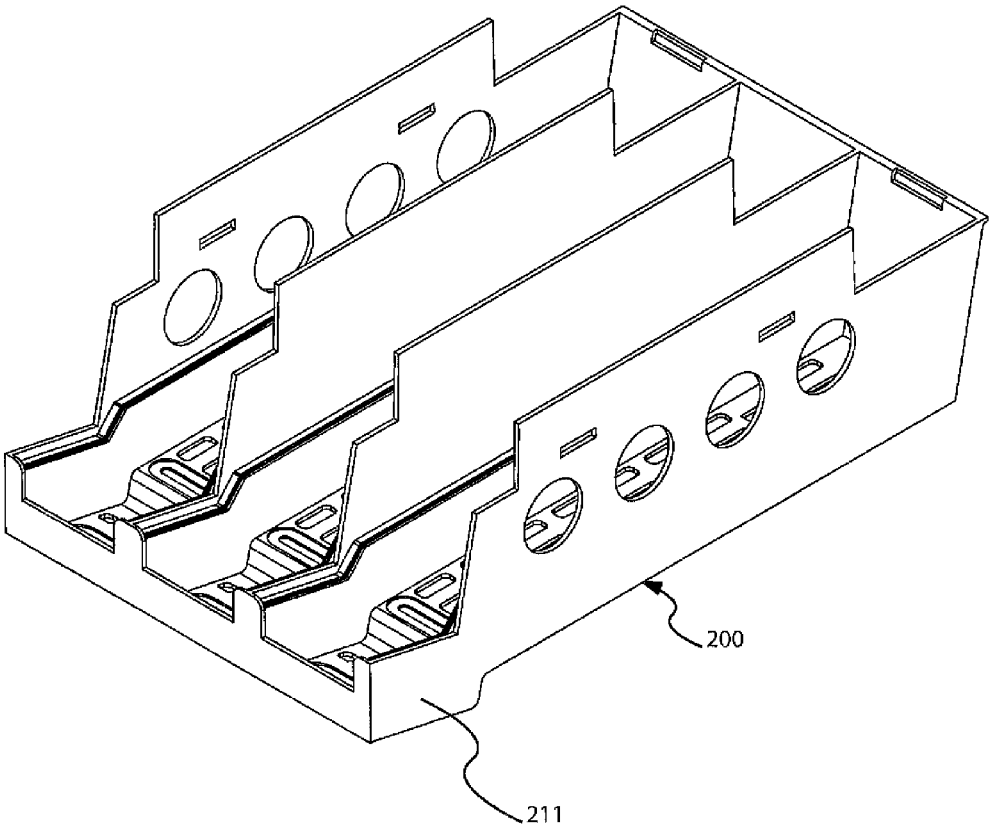
FIG. 7 is a front perspective view of the second embodiment.
Figure 8:
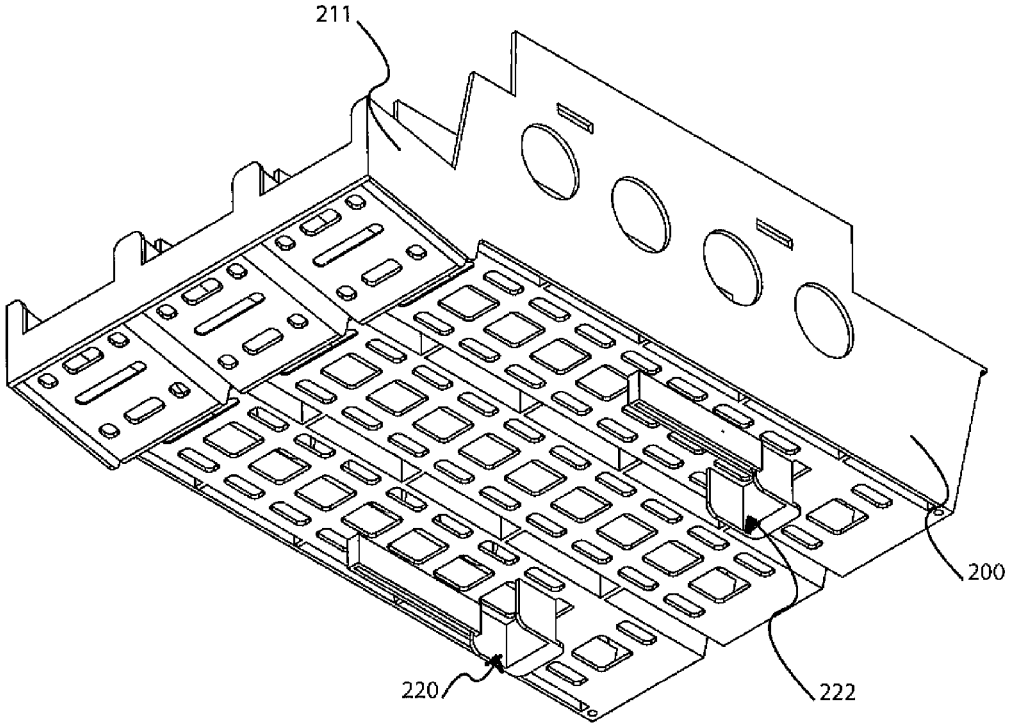
FIG. 8 is a bottom perspective view of the second embodiment.
Figure 9:
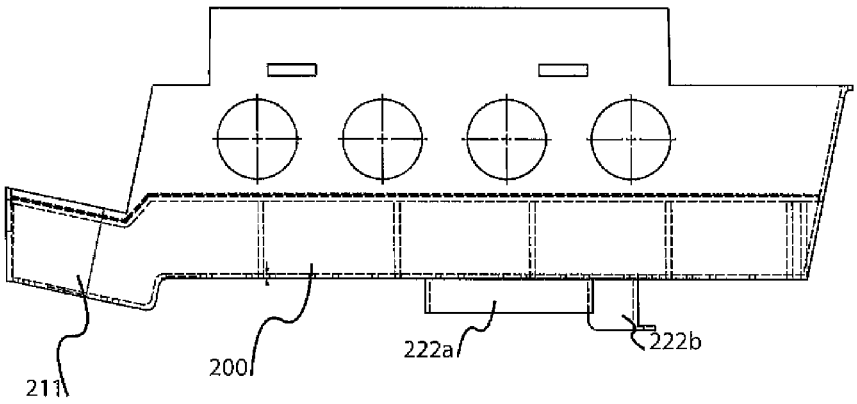
FIG. 9 is a side view of the tray of FIG. 6.
Figure 10A:
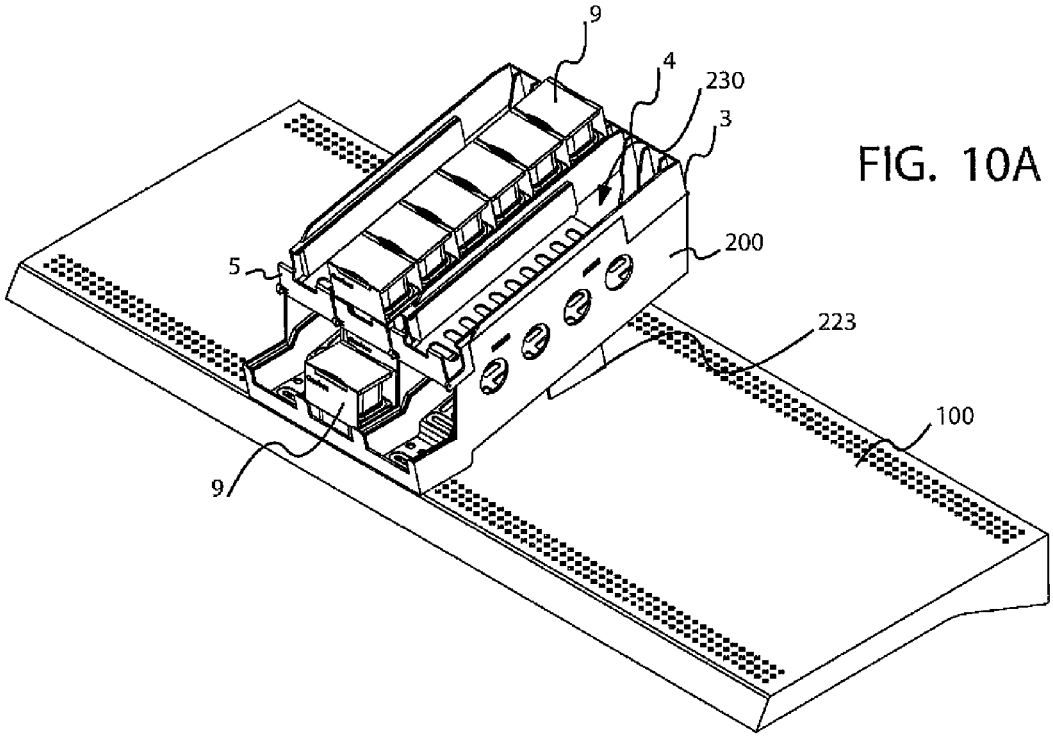
FIG. 10A is a front perspective view of the embodiment shown in FIG. 6 on a shelf.
Figure 10B:
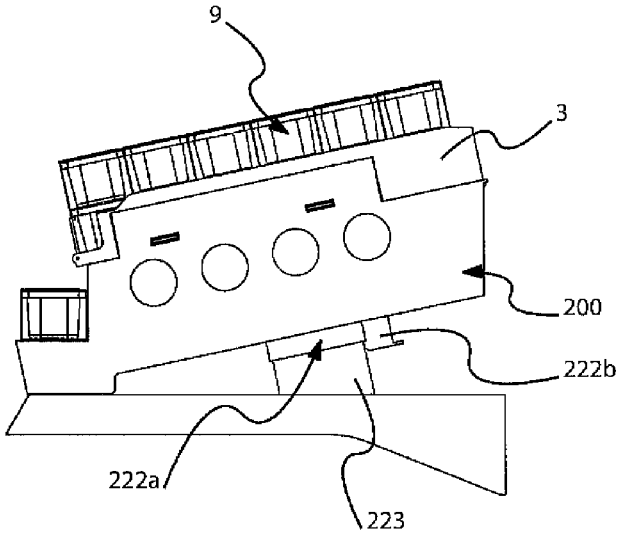
FIG. 10B is side view of the embodiment of FIG. 10A.

FIG. 7 shows a front perspective view of this tray 200 which includes dispensing extension section 211. FIGS. 8 and 9 show a bottom perspective view, and a side view respectively of this tray 200 which includes support brackets 220 and 222 which are formed underneath a floor of the tray 200. FIG. 9 shows a side view which shows a first extension 222*a* and a second extension 222*b*. These support brackets 220 and 222 can be configured to receive a lift 223 (See FIGS. 10A and 10B). FIG. 10A also shows the opening 230 between top tray 3 and bottom tray 200 which allows the product to fall therethrough and be guided by snaps 4.

Figure 11:
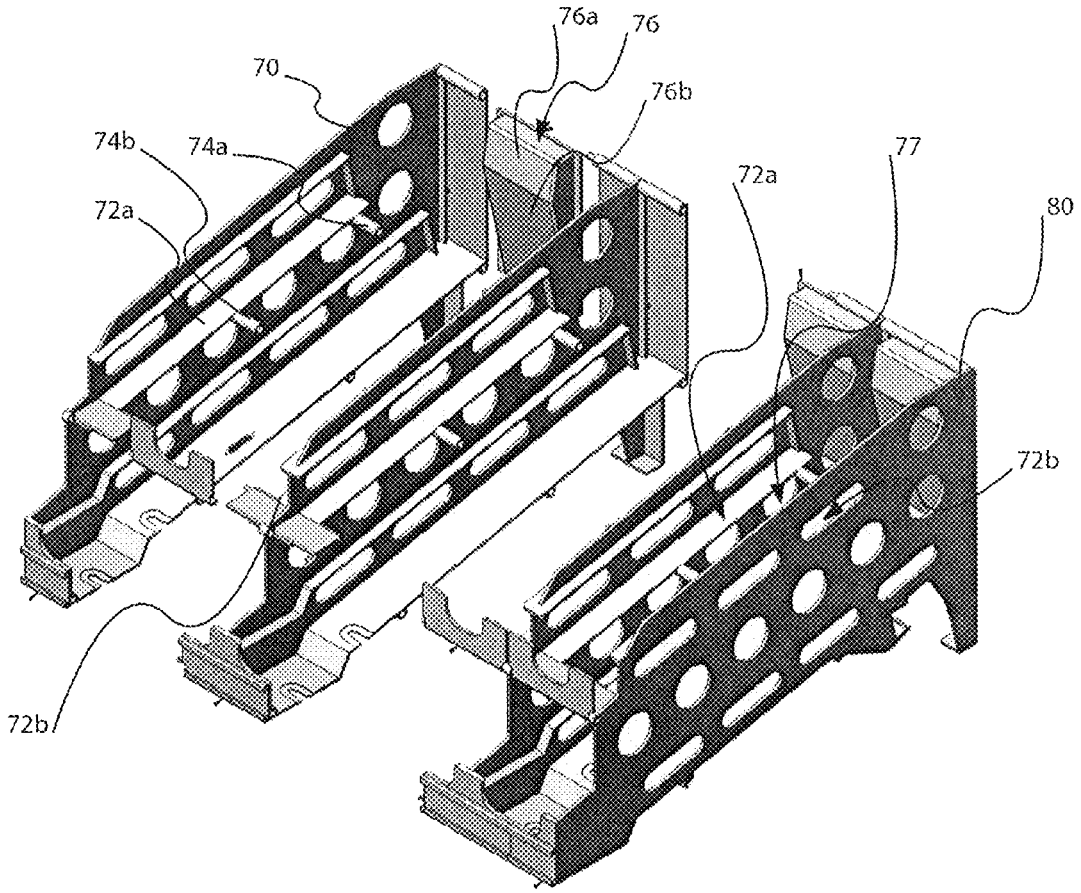
FIG. 11 is a front perspective view of another embodiment.

FIG. 11 shows a perspective view of another embodiment of the invention. In this embodiment, there is shown a double decker tray which is assembled by putting a plurality of lateral pieces of the tray together. This tray 70 includes a plurality of shelf extensions 72*a* and 72*b* which are bounded by a gap 77 and have cross extensions 74*a* and 74*b* extending in between. This gap 77 is configured to reduce the amount of friction interaction between the product and the shelves as well as saving on material. This embodiment also includes a plurality of angled back surfaces 76*a* as well. These back surfaces 76*a* are configured to have a substantially triangular cross-section. In addition, with these embodiments, it is noticed that the side walls have holes or gaps in material. These holes or gaps in material are largely for reducing the amount of material necessary to construct these parts.

Figure 12:
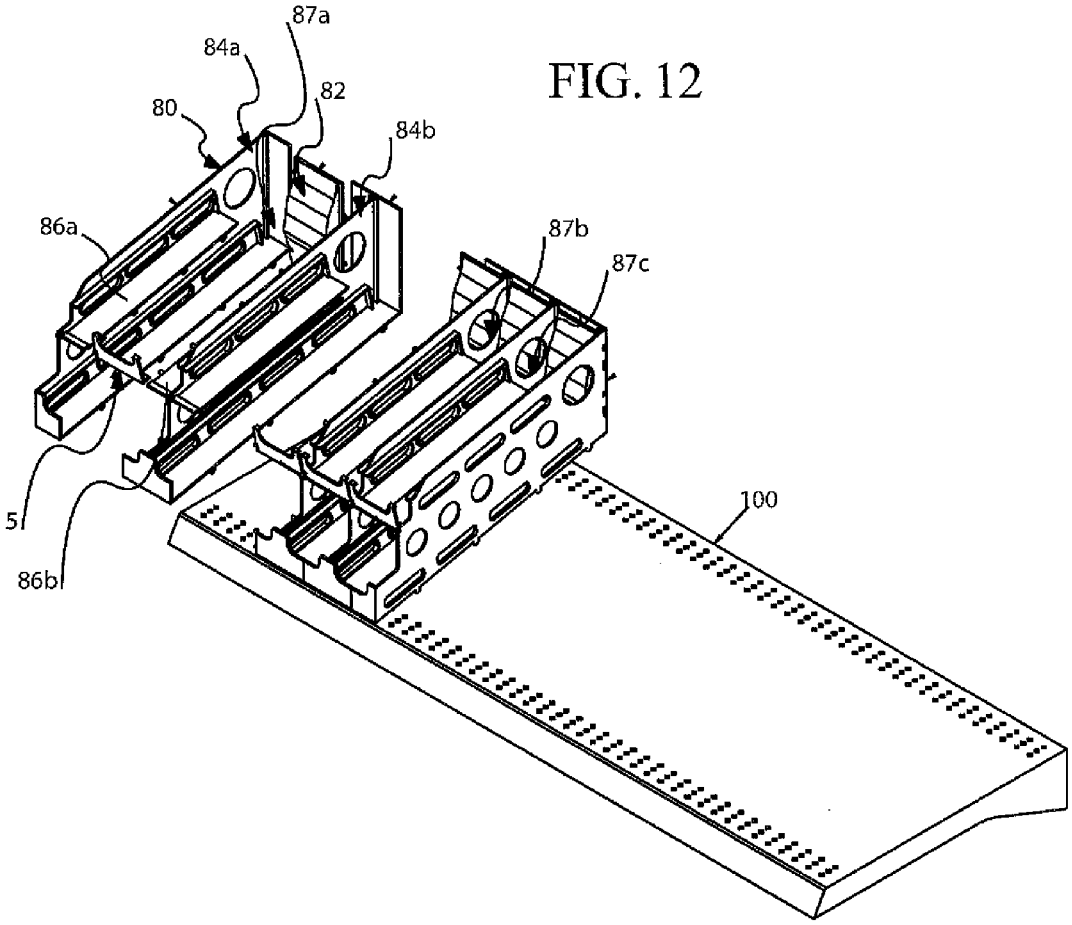
FIG. 12 is a front exploded view of another embodiment.
Figure 13:
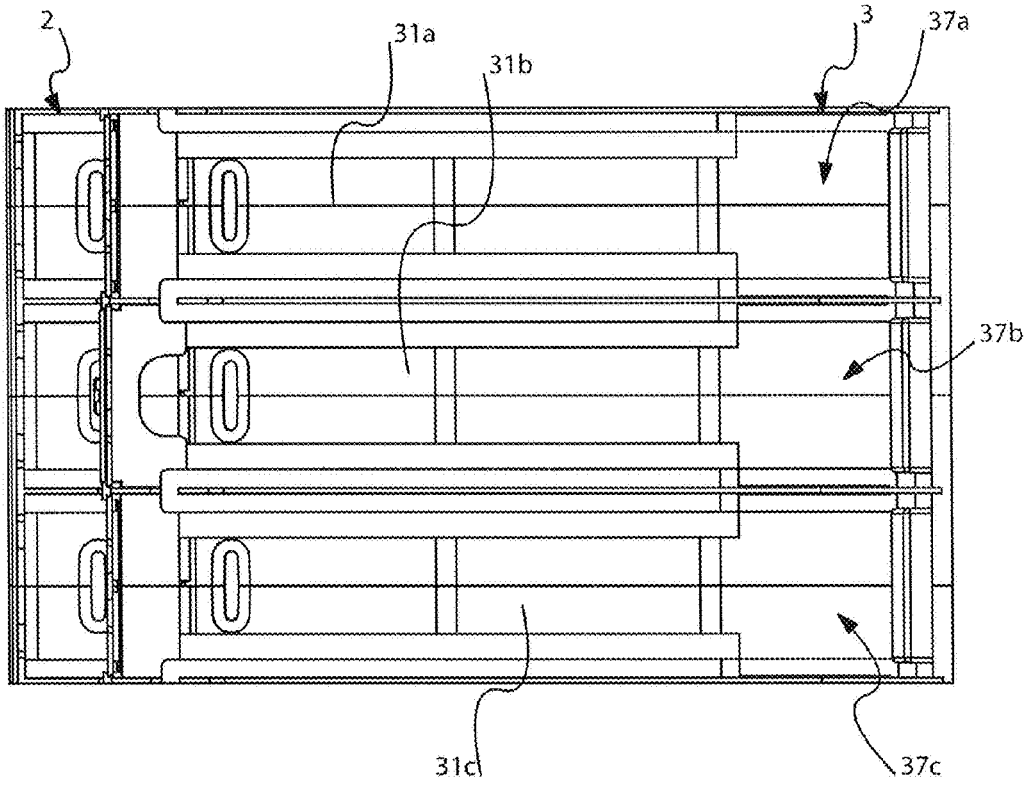
FIG. 13 is a top view which is representative of the embodiments of FIGS. 6 and 11.

FIG. 12 shows a perspective view of another embodiment of the invention. In this view there is shown a tray 80 which includes a plurality of channels with the floor to these channels formed by floors 86*a* and 86*b*. A door 5 is shown configured to couple to these floors as well. In addition a back guide 82, having angled surfaces, is shown at a back section of this tray, which is configured to guide the product as it falls from the top tray to the bottom tray via holes or gaps in floor 87*a*, 87*b*, 87*c*. In all of these embodiments, the top tray is configured to have openings or holes which allow product to fall or slide down from the back of top tray 3 into bottom tray 2, 200, 70 or 80. Thus, as shown in FIG. 13 which is a top view showing slots 31*a*, 31*b*, 31*c*, wherein there are holes or openings such as openings 37*a*, 37*b*, 37*c* which are formed as gaps in the respective floors 31*a*, 31*b*, 31*c* of top tray 3.

Figure 14:
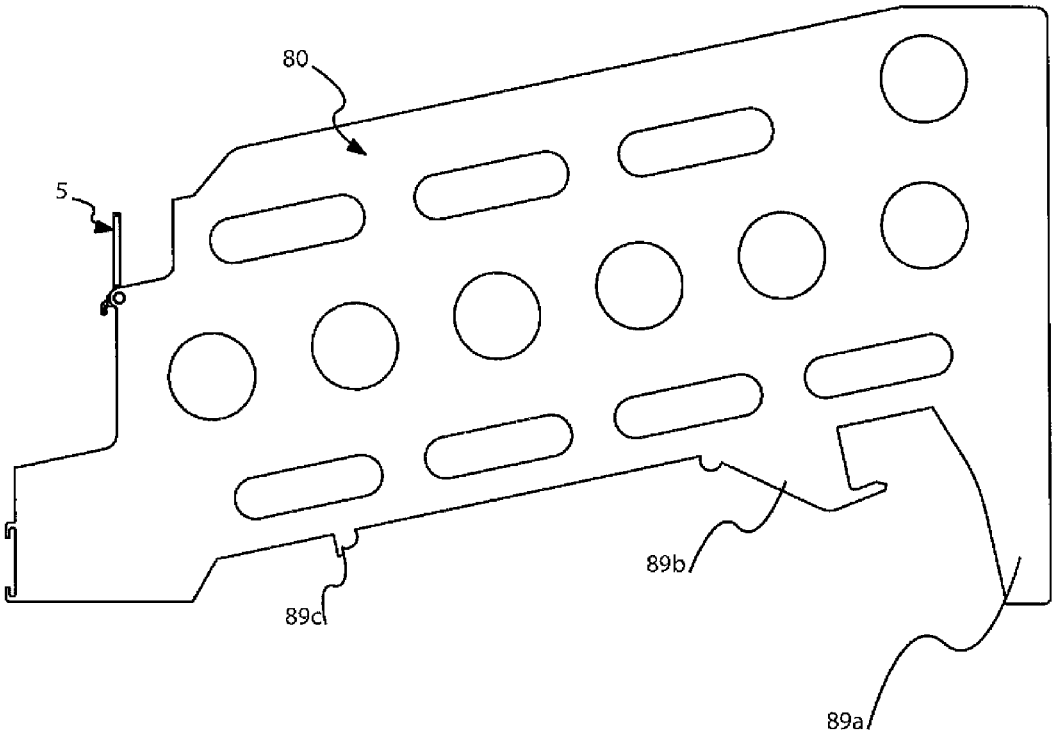
FIG. 14 is a side view of the embodiment of FIG. 12.

These designs can be formed as stacked trays or all in one two tier trays such as that shown in FIG. 14 which shows a side view of tray 80 which is shown as a single piece tray. This tray includes a back angled extension 89*a* to support the tray on an angle, a hook extension 89*b* which is configured to hook around a support bar such as support bars 12 and 14 and a protrusion 89*c* which is configured to support the device against a rack or support bar such as bar 12 and 14 as well.

Figure 15:
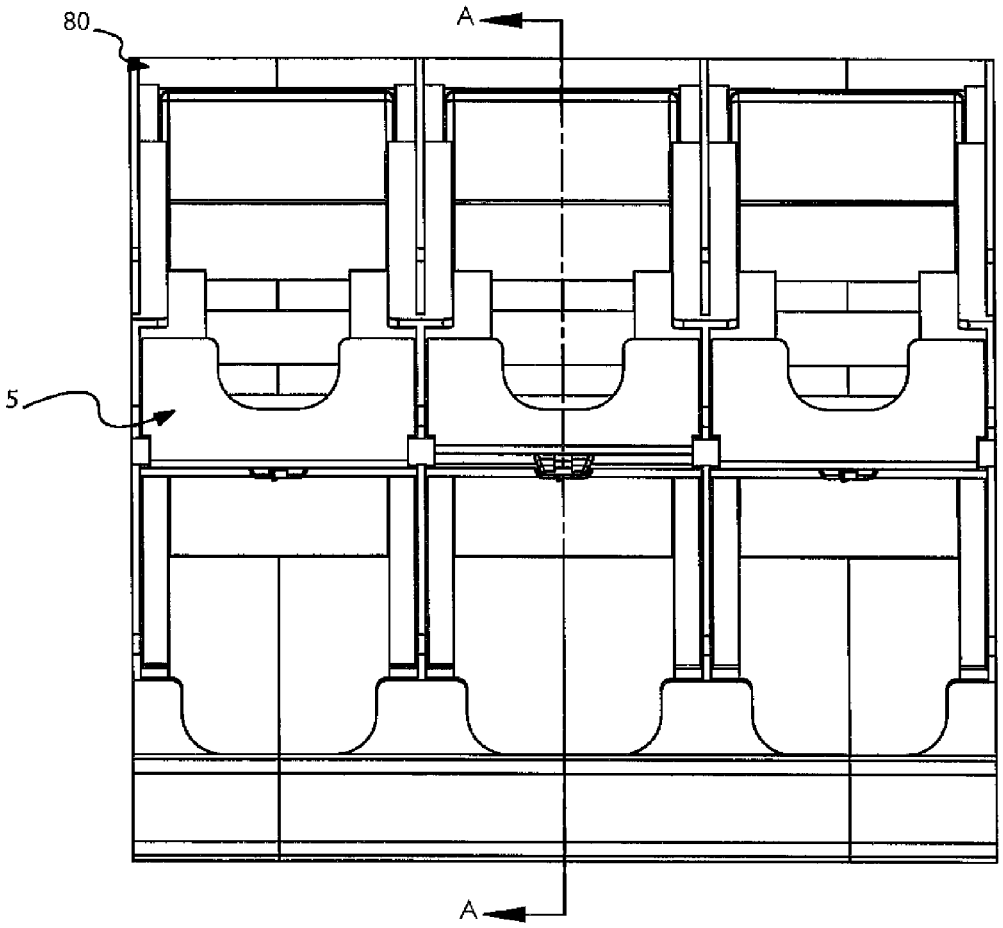
FIG. 15 is a front view of the device of FIG. 12.
Figure 16:
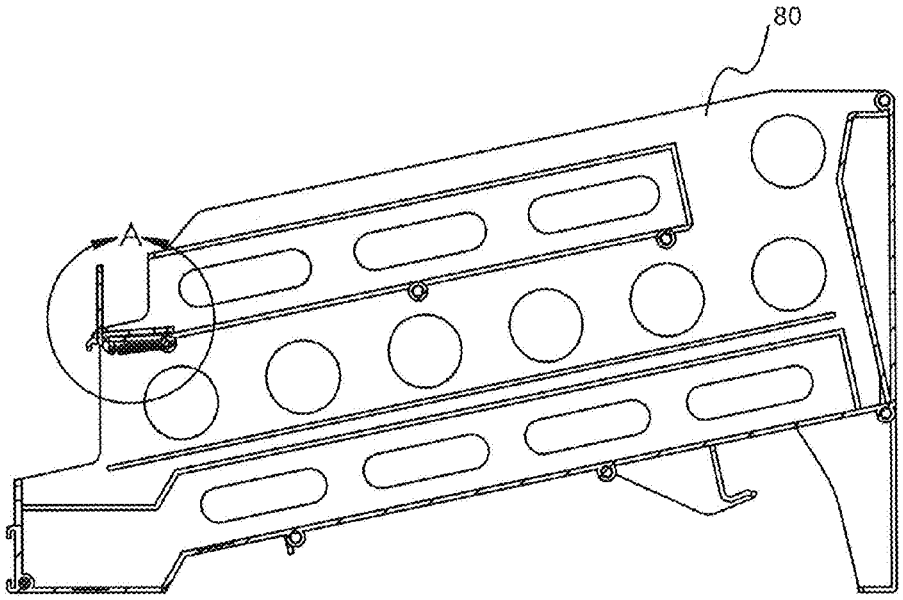
FIG. 16 is a side view of the embodiment of FIG. 12.
Figure 17:
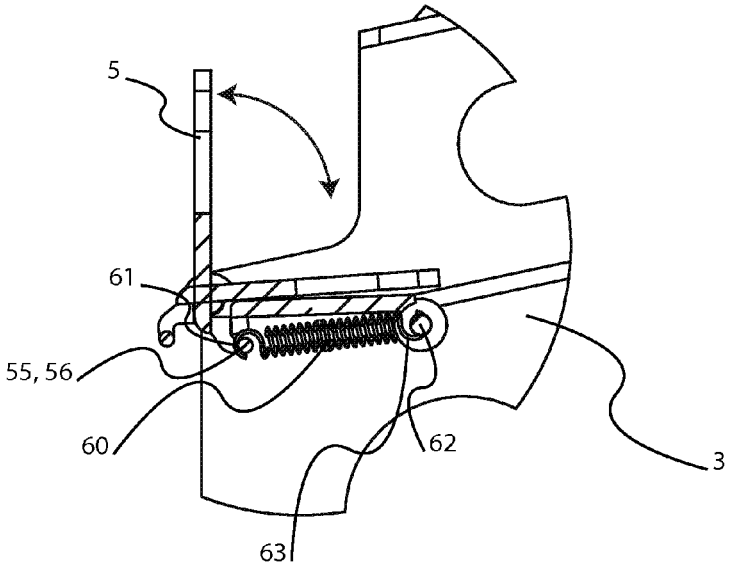
FIG. 17 is a sectional view taken from section A-A from FIG. 16.

FIG. 15 shows a front view of this design which shows door 5 coupled to tray 80. FIG. 16 shows as side view of the device 80 while FIG. 17 shows as section A taken from this view as well. FIGS. 17 and 3C are substantially similar.

Figure 18:
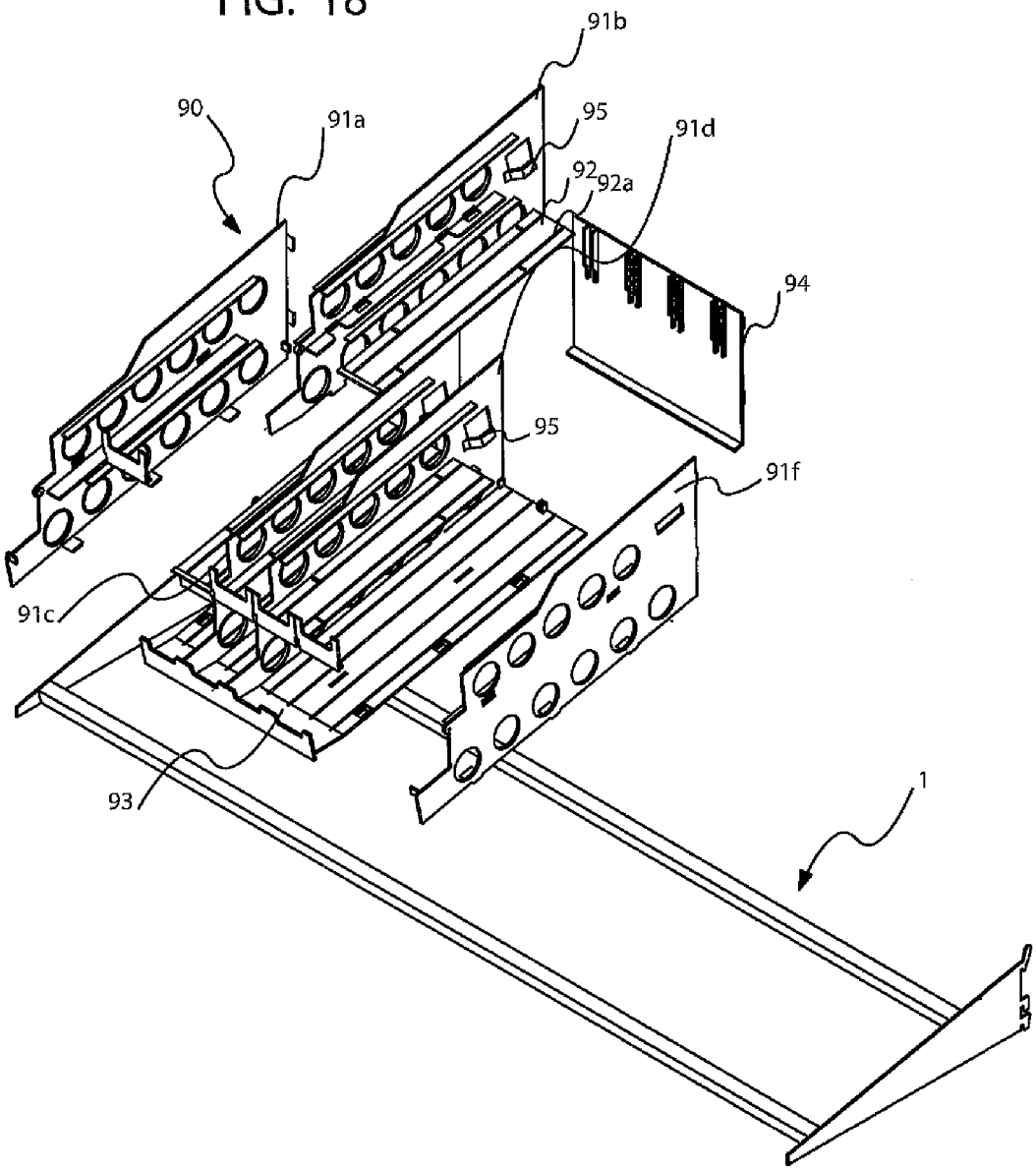
FIG. 18 is another embodiment of the invention.

FIG. 18 is an exploded perspective view of another embodiment of a tray that can be coupled together through a lateral, rather than stacked coupling. In this design, there are a plurality of tray floors 92 which extend into the channels for allowing product to slide thereon. These floors include dust brackets or protrusions which elevate the product above the channel floor. In addition, there is shown a spring clip which can be coupled onto the side walls such as any one of side walls 91*a*, 91*b*, 91*c*, and 91*d*. Spring clip 95 can be formed integral, but in at least one embodiment is formed from a separate material from the tray. Clip is configured in a bent or angled manner with a bevel so that it is configured to extend laterally into the channel in the region just above the opening for the product to drop from the top level of the tray to the bottom level of the tray. This spring clip therefore can act as a guide to guide the product as it drops from one level to another.

Figure 19:
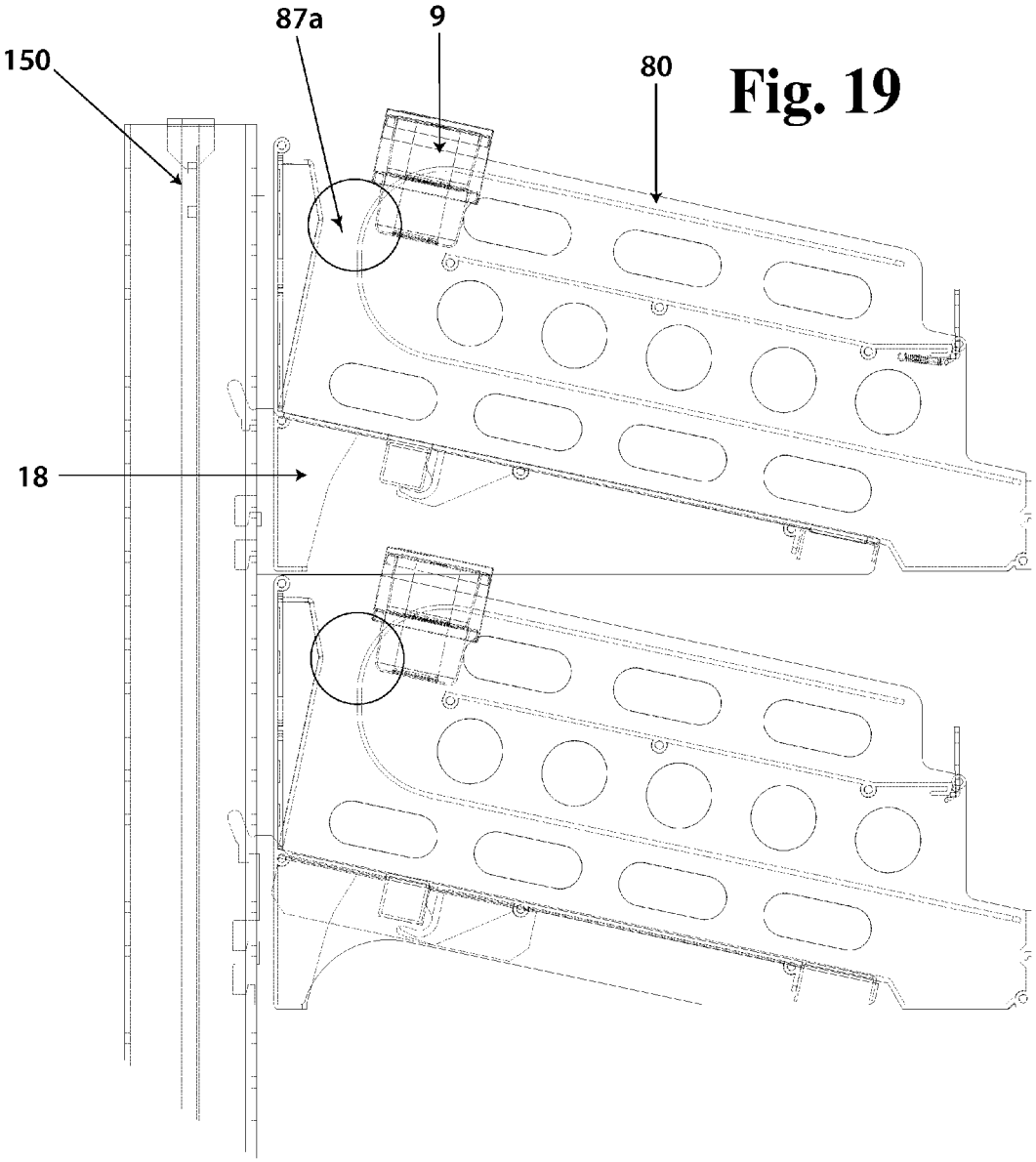
FIG. 19 is a side view of the product in a position to drop down.
Figure 20:
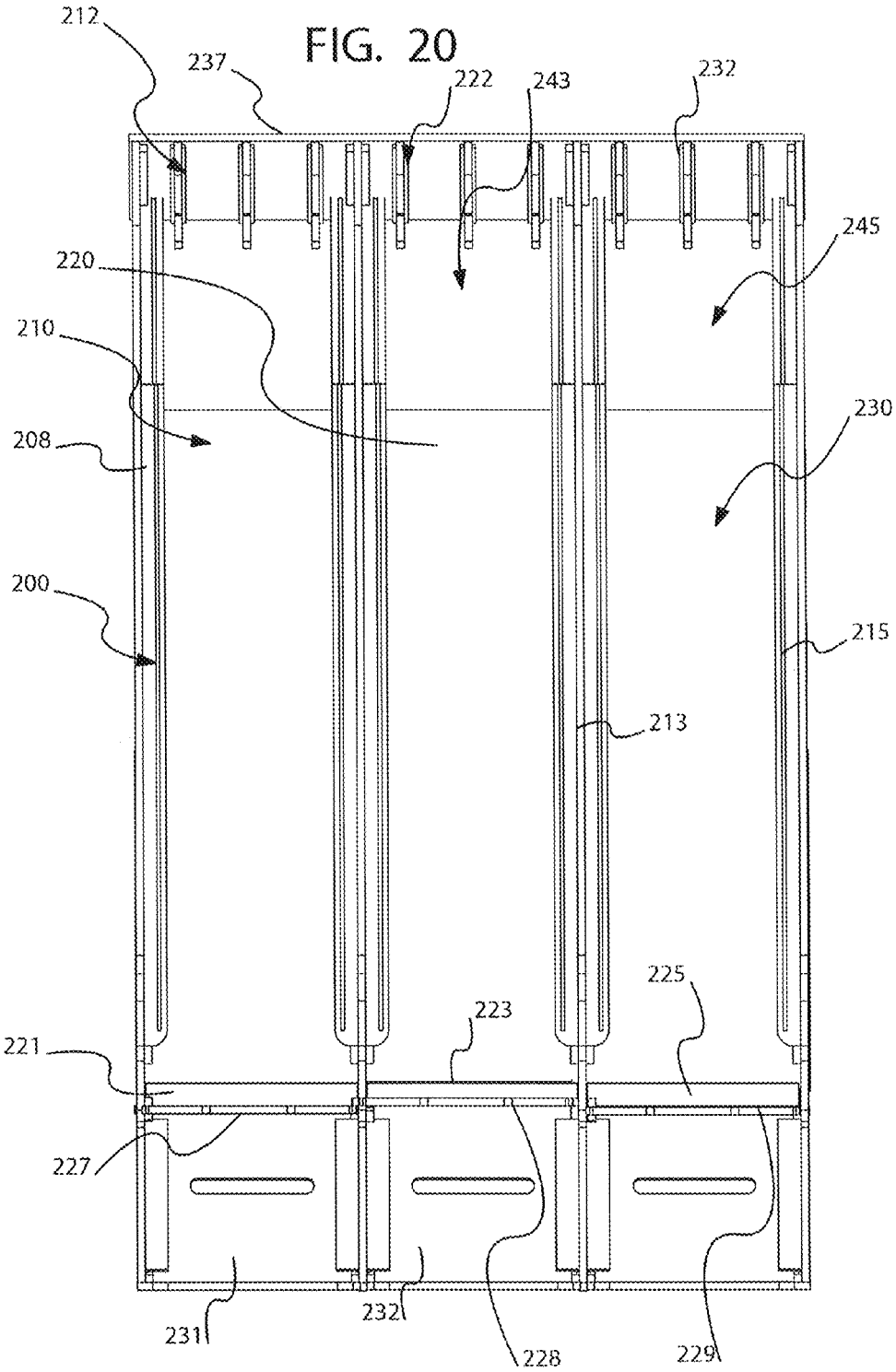
FIG. 20 is a top view of another embodiment.

In all, the design is configured to provide an easily front loaded tray wherein a user can load the top tray and the bottom tray. After a period of time, if the unit is to be recharged with new product, then the user can insert more product into the system from the top tray, thereby dropping the remaining product from the top tray into the bottom tray to push the remaining product from the top tray and the bottom tray to the front of the bottom tray. As shown in FIG. 19 there is a tray 80 installed onto a bracket 18 which is coupled to a column 150 for a display. Product 9 can be pushed to the back of top section of tray 80 to an opening or hole 87*a* where the product will eventually drop down. This design therefore prevents the pushing of old product to the back of the tray where it will sit and eventually expire. This is done so that the bottom shelf is automatically stacked in a first in-first out basis.

Figure 21:
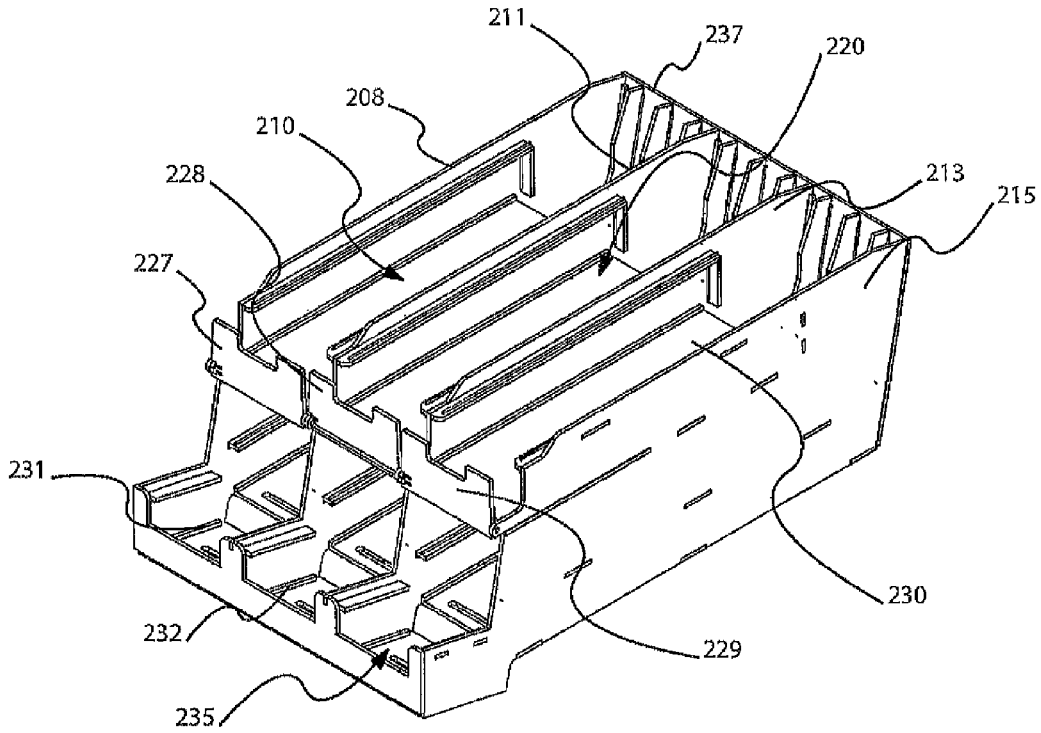
FIG. 21 is a side view of the embodiment of FIG. 20.

FIGS. 20-24 represent another embodiment. In this view, there is shown a two tiered tray 200 which has side walls 208, 211, 213, and 215. Between these side walls are channels 210, 220, and 230. There is an angled or sloped section 221, 223, and 225 respectively, with a display section 231, 232, and 235 for receiving product that is dispensed from a lower or first tray. There is also a hole or opening 241, 243, and 245 for dropping product down therein. Back guides 212 are positioned on a back surface 237 to guide product that falls therein. FIG. 21 shows a side view of this embodiment, wherein there are doors 227, 228, and 229 which are U-shaped and which are spring loaded and set to fold down. Product such as product 9, can then slide down channels 210, 220 and 230 and fall from the second tier to the first tier and then flow to the open regions 231, 232, and 235. In those regions, users can then lift this material up and out and take it to a counter to purchase it.

Figure 22:
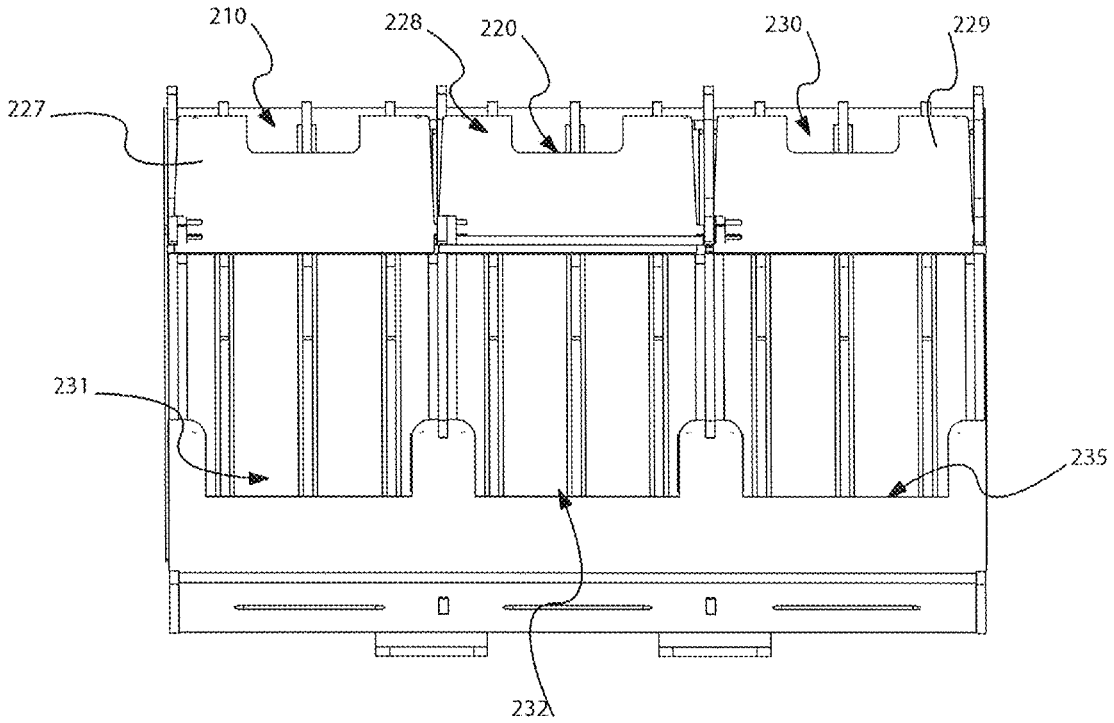
FIG. 22 is a front view of the embodiment of FIG. 20.
Figure 23:
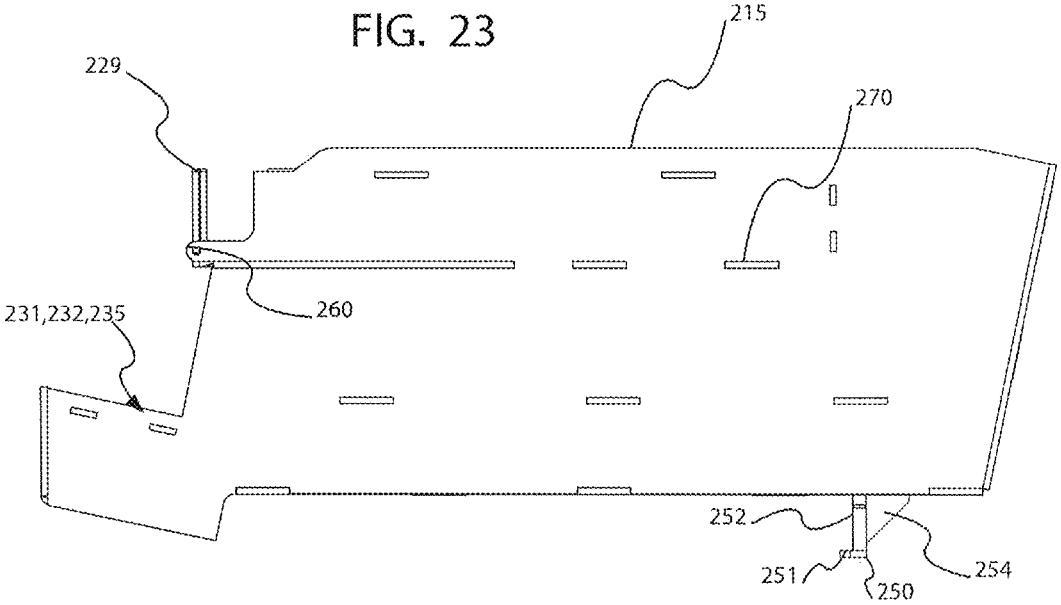
FIG. 23 is a side view of the embodiment of FIG. 20.

FIG. 22 shows a front view of this embodiment while FIG. 23 shows a side view. In this side view, there is a bottom prong 250 which extends down via leg 252 and has a back support 254. A flange 251 extends out and is used to secure the bottom prong 250 to a stand. This device can then be positioned on an angle on the stand or be positioned substantially flat as well. This prong 250 is configured to hook onto the rear support bar from behind. With these doors 229 there is a spring which is configured to spring load the door shut. In this case the spring is configured as an extension spring wherein it currently attaches to the upside-down "U" cutout in the upper floor, attaching from above the floor.

There is also a steel rod 260 that acts as a hinge for better engagement and overall strength. In addition, the holes on the side of the device such as shown with reference numeral 270 are configured as material saving holes.

Figure 24:
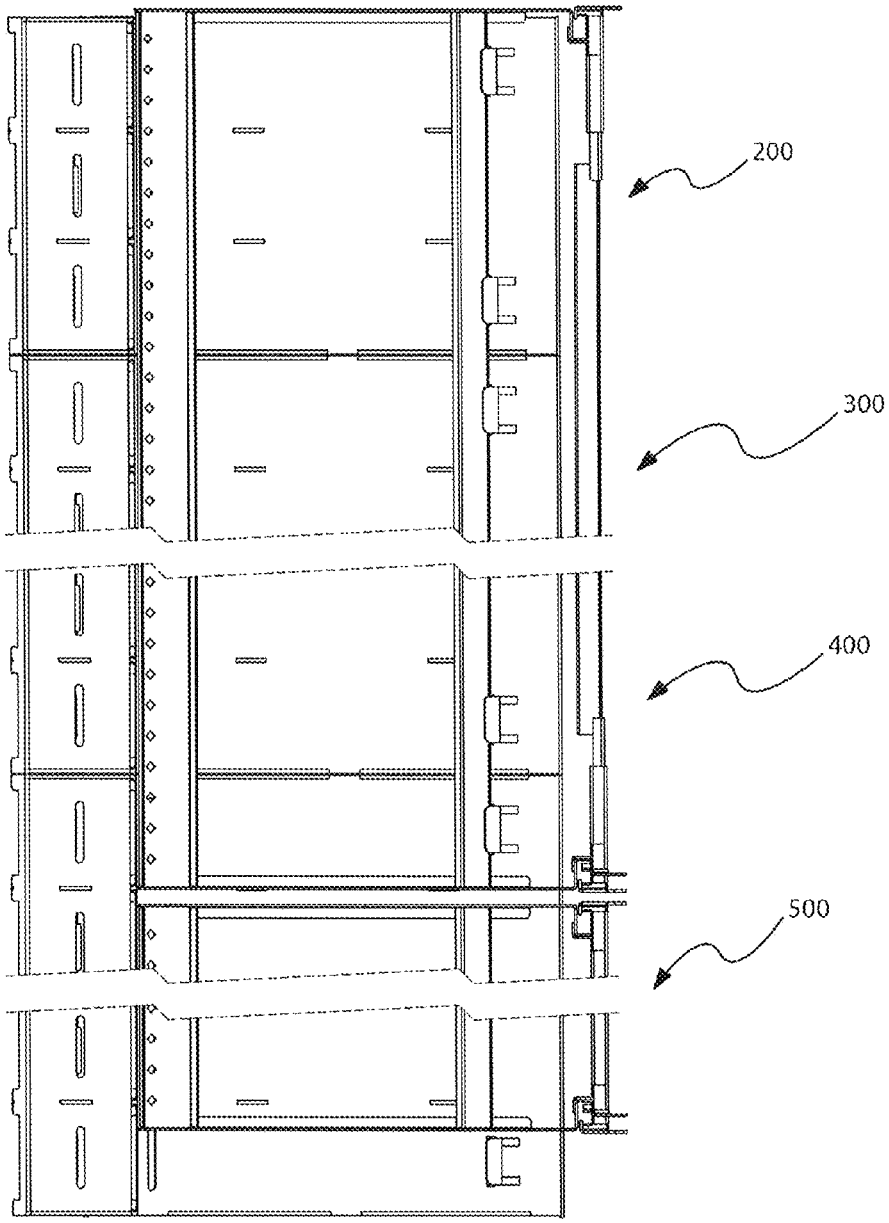
FIG. 24 is a top view of another embodiment.

FIG. 24 show a top view of the device which shows a plurality of different compartments or components 200, 300, 400, and 500, which are positioned adjacent to each other.

Figure 25:
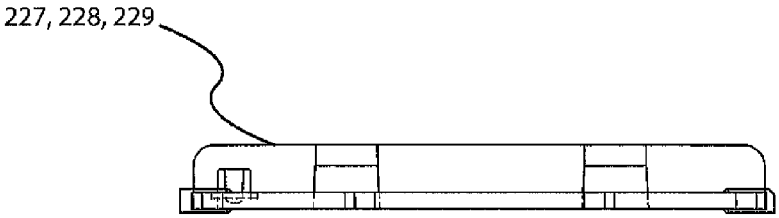
FIG. 25 is a bottom view of the door shown in FIG. 21.
Figure 26:
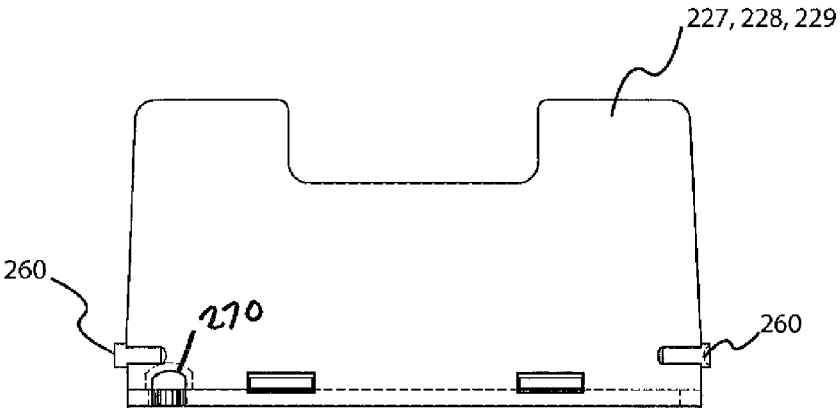
FIG. 26 is a side view of the door shown in FIG. 25.
Figure 27:
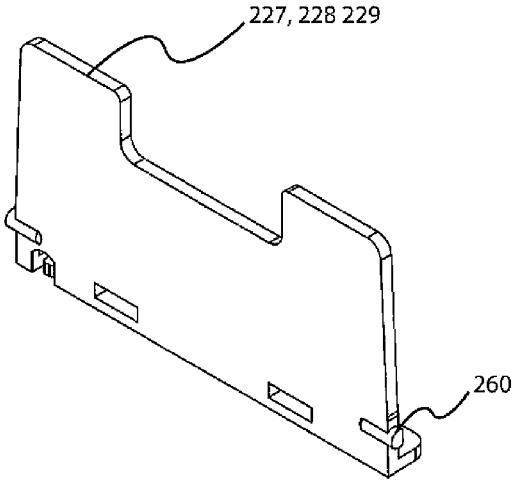
FIG. 27 is a side perspective view of the door shown in FIG. 25.
Figure 29:
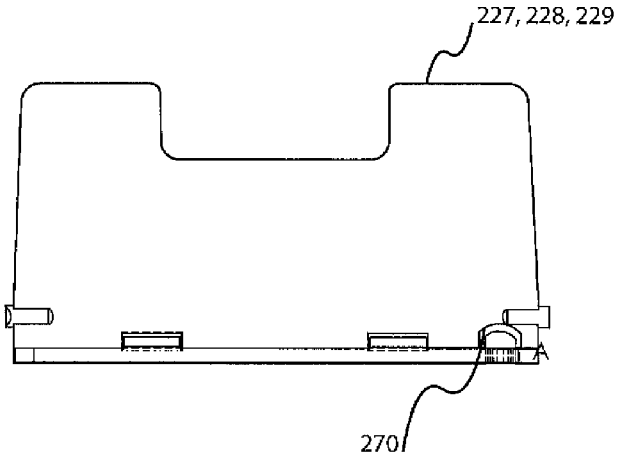
FIG. 29 is a front view of the door shown in FIG. 25.

FIGS. 25-40 show up close views of the door. FIG. 25 shows an end view of doors 227, 228, 229. FIG. 26 shows a front view of the doors 227, 228, 229 as well. In this view, there is a rod 260 which extends through the door and is used as an axle for the door. In addition, there is a U-shaped spring 270 See FIGS. 26 and 29, which is coupled to the door. The U-shaped spring extends underneath the door and is configured to spring load the door in an upright position. FIG. 30 shows a side view of the door, showing a bottom section 227*b*, 228*b*, 229*b* extending out in an L-shaped manner from door front 227, 228, 229. FIG. 31 shows a U-shaped spring for holding the door up, while FIG. 32 shows the U-shaped spring in closer view.

FIG. 33 shows an end view of the door with section 227*b*, 228*b*, 229*b* asd well as hinge 260 as well. Section 227*b*, 228*b*, and 229*b* are L-shaped with respect to the door as well. FIG. 34 shows a front view of the door which shows door 227, 228, 229 coupled to hinge 260 as well.

FIG. 35 shows a perspective view of the door 227, 228, 229 which is coupled to axle 260 as well. FIG. 36 shows a side view while FIG. 37 shows a front view of the door. FIG. 39 shows a back view of the door while FIG. 38 shows a side-cross-sectional view of the door with axle 260 and bottom section 227*b*, 228*b*, 229*b*. Bottom section 227*a*, 228*a* and 229*a* is a channel for receiving a rotatable axle 260. FIG. 40 shows an up close view of the U-shape spring area 270. In all, this type of door 227, 228, 229 is configured so that it can be easily set to an upright position, biased in this upright position and set to stay upright so that it holds elements in place.

Thus, there is a multi-tiered or shelved display comprising at least two levels for holding a product on display; at least one hole in a top level configured to allow the product to drop from the top level to the bottom level and at least one rotatable door configured to fold down to allow product to be inserted into at least one of the levels such that the bottom level is arranged with product in a first-in, first-out basis.

Accordingly, while different embodiments of the present invention have been shown and described, it is to be understood that many changes and modifications may be made thereunto without departing from the spirit and scope of the invention as defined in any appended claims.

What is claimed is:

1. A two tiered tray system comprising;

a) a lower level tray (2) comprising a set of rows;

b) an upper level tray (3) comprising:

an upper set of rows, and an upper level tray floor (31*a*-31*c*);

wherein said upper level tray floor has a floor opening (37*a*-37*c*) at a back end in communication with the lower level tray;

c) at least one upper level door (5) coupled to said upper level tray wherein said upper level door is positioned at a front end of said upper level tray; and d) at least one hinge coupling said upper level door to said upper level tray, in which the upper level tray and the lower level tray both slope upwardly, from front to back;

a back wall (28), comprising an upper back wall and a lower back wall;

a plurality of back wall snaps (4) configured to control the flow of product from the upper level tray to the lower level tray;

a plurality of back wall slots (36) configured to snap-mount the snaps (4); said back wall snaps (4) are configured to couple to the lower back wall (28) of the lower level tray (2) in slots (36);

the back wall snaps each include:

a protrusion (47) which is configured to snap into the slots (36), to lock thereto;

a plurality of angled surfaces including:

an upper forwardly descending surface (43), configured to tilt the product top-backwardly;

a backwardly descending surface (44) configured to guide the product;

mid-forwardly-descending surface (45), configured to guide the product; and a lower backwardly descending surface (46) configured to guide the product.

* * * * *